United States Patent [19]

Müller et al.

[11] Patent Number: 5,073,134

[45] Date of Patent: Dec. 17, 1991

[54] BOAT DRIVE WITH ADJUSTABLE PITCH PROPELLER

[76] Inventors: Peter Müller, Isengrund 9, CH-8134 Adliswil; Urs Morgenthaler, Seeblick, CH-8832 Wollerau, both of Switzerland

[21] Appl. No.: 635,739

[22] Filed: Dec. 28, 1990

[30] Foreign Application Priority Data

Jan. 4, 1990 [DE] Fed. Rep. of Germany ..... 4000115

[51] Int. Cl.[5] ..... B63H 3/08

[52] U.S. Cl. ..... 440/50; 416/163

[58] Field of Search ..... 440/49, 50, 76, 77, 440/78, 79, 83; 416/163, 167

[56] References Cited

U.S. PATENT DOCUMENTS

| | | | |
|---|---|---|---|
| 2,704,991 | 3/1955 | Danielson | 440/50 |
| 2,850,106 | 9/1958 | Swan | 416/163 |
| 3,138,136 | 6/1964 | Nichols | 440/50 |
| 3,895,598 | 7/1975 | Blickle | 440/50 |
| 4,231,317 | 11/1980 | Brandt et al. | 440/50 |
| 4,810,166 | 3/1989 | Sawizky et al. | 416/167 |
| 4,964,822 | 10/1990 | Mueller | 440/50 |
| 5,028,210 | 7/1991 | Peterson et al. | 440/50 |

*Primary Examiner*—Jesus D. Sotelo
*Assistant Examiner*—Stephen P. Avila
*Attorney, Agent, or Firm*—Herbert Dubno

[57] ABSTRACT

A boat drive of the type in which a housing outside the hull of the board and below the water level receives a hollow propeller shaft driven by a drive shaft connected to the propeller shaft by a transmission. The hub of a variable pitch propeller is mounted on the propeller shaft and the axially extending stems which adjust the pitch on this hub are engaged by a push rod extending through the prop shaft and connected to a double acting cylinder at the opposite end from that at which the rod is connected to the stems.

16 Claims, 3 Drawing Sheets

BOAT DRIVE WITH ADJUSTABLE PITCH PROPELLER

FIELD OF THE INVENTION

Our present invention relates to a boat drive with an adjustable pitch propeller and, more particularly, to a boat drive of the type in which the adjustable pitch propeller has its blades mounted on a hub which is fastened to a hollow propeller shaft and the adjustment is effected by means of stems which are axially displaceable in the hub. Such drives are commonly received in the housings of outboard motors, so-called Z-drives and shaft palms which extend downwardly from the hull of a boat.

BACKGROUND OF THE INVENTION

A conventional boat drive of the type in which a propeller shaft in a housing connected to the bottom of the hull of a ship or forming an outboard motor or part of a Z-drive can have a transmission in the housing which connects a drive shaft reaching upwardly in the housing to an engine, to a propeller shaft on which the hub of the variable pitch propeller is mounted. The blades are pivotal on this hub by an appropriate mechanism and the propeller shaft may be hollow to accommodate a pusher to adjust the pitch.

In the boat drive of this type described in U.S. Pat. No. 2,850,106, the positioning device for the push rod is located in the hull of the ship and is connected by a transmission with the push rod. The push rod extends only partly through the hollow propeller shaft and carries at an end thereof radial stems which traverse openings in the hollow propeller shaft to reach into the hub. This construction has not found widespread practical utility and has not only structural and functional disadvantages but makes mounting or dismounting of the parts for repair or maintenance time consuming and expensive.

More recent constructions, e.g. as described in European Patent Document EP 0231503, have a more compact construction in which the blade-adjustment stems extend parallel to the propeller shaft. It has been found that, although this system is highly effective, it is capable of improvement with respect to the ability to maintain and repair the unit, can be simplified with respect to the actuation of the pusher rod and, in general, can be improved upon.

OBJECTS OF THE INVENTION

Accordingly, it is an object of the present invention to provide an improved boat drive which extends the principles of the system described in the above-identified Europatent application and overcomes drawbacks of prior art systems.

Another object of the invention is to provide a more versatile boat drive which has improved capacity for maintenance and repair and a more rational arrangement of the drive for the push rod.

Still another object of the invention is to provide an improved boat drive having high structural stability, simplified construction and improved operating characteristics.

SUMMARY OF THE INVENTION

These objects and others which will become apparent hereinafter are attained, in accordance with the invention by providing the push rod so that it projects at the free end of the hub from the hollow propeller shaft and is there releasably connected to the adjustment stems which are connected to the blades and, upon axial displacement, pivot the blades to adjust the pitch thereof.

According to an issue feature of the invention, the push rod also extends from the other end of the hollow propeller shaft and is connected to a double acting fluid operated cylinder which is provided directly in the housing in which the propeller shaft is journaled and on which the hub and blades of the propeller are mounted by being affixed to the propeller shaft.

According to the invention, therefore, the boat drive comprises:

a drive housing projecting from a hull of a boat;

a hollow propeller shaft journaled in the housing;

means in the housing for rotating the propeller shaft;

a propeller hub mounted on the propeller shaft and provided with a plurality of adjustable-pitch propeller blades, and respective blade-adjustment stems extending parallel to the propeller shaft and shiftable in an axial direction to adjust a pitch of the blades, the hub having an end turned toward the housing and a free end turned away from the housing;

a pitch-adjustment push rod passing through the propeller shaft, projecting out of the hub with one extremity of the push rod at the free end of the hub and axially shiftable in the propeller shaft;

means for releasably connecting the one extremity to the blade-adjustment stems for varying the pitch of the blades upon axial displacement of the push rod, the push rod extending at an opposite extremity out of the propeller shaft; and a double-acting piston-and-cylinder unit in the housing connected to the opposite extremity of the push rod for axially displacing same.

According to a feature of the invention the means for releasably connecting the extremity of the push rod to the blade adjustment stems includes screw connections between the stems and the push rod and a disk or washer which can surround the push rod. The screw connection can be effected by forming the stems and push rod with threaded ends which pass through holes in the disk and nuts threaded onto these ends and clamping the disk against shoulders of the push rod and the stems.

The disk can be a ring or yoke which connects the push rod with the stems.

These screw fastening elements are accessible from the exterior and are easily tightened or removed so that both removal of the hub and its replacement can be effected simply and rapidly.

The removal of the shaft hub from the hollow propeller shaft or the fastening of the hub onto the latter is simplified according to the invention by providing the hollow propeller shaft at a distance from the hub end thereof with an abutment or shoulder against which the hub can seat while the hub end of the propeller shafts itself is formed with an external screw thread onto which a nut is threaded which can retain the juxtaposed end of the hub against axial movement.

Upon removal of the aforementioned disk and release of the latter nut, the hub with blades and stems thereon can be simply drawn off the hollow propeller shaft.

The incorporation of the double acting fluid operated cylinder in the housing can be effected without difficulty. Especially effective results are obtained when the actuating cylinder is received in a removable cap of the housing. It will be understood that this cap can have a streamlined configuration to minimize turbulence and can conform to the configuration of the housing, be flush with the remainder of the housing. Upon removal of the cap from the housing, the cylinder as well is accessible from the exterior. Fluid lines, i.e. piping, for the fluid medium, connected to the hydraulic cylinder can be received in passages provided in the housing and the cap so that any pump required to supply the fluid under pressure can be accommodated in the body of the boat.

According to a further feature of the invention, between the actuating cylinder and the push rod, an axial bearing effective in both axial directions is provided so that the push rod within the hollow propeller shaft can rotate with the latter The axial bearing itself is protected by being received within the housing and/or the cap. The axial bearing also insures that in the region of the eternally accessible connection between the push rod and the adjustment stems, no relatively movable parts will be required. It has been found to be advantageous, moreover, to journal or support the push rod at the hub end of the hollow propeller shaft and to seal the push rod against the propeller shaft at this end.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
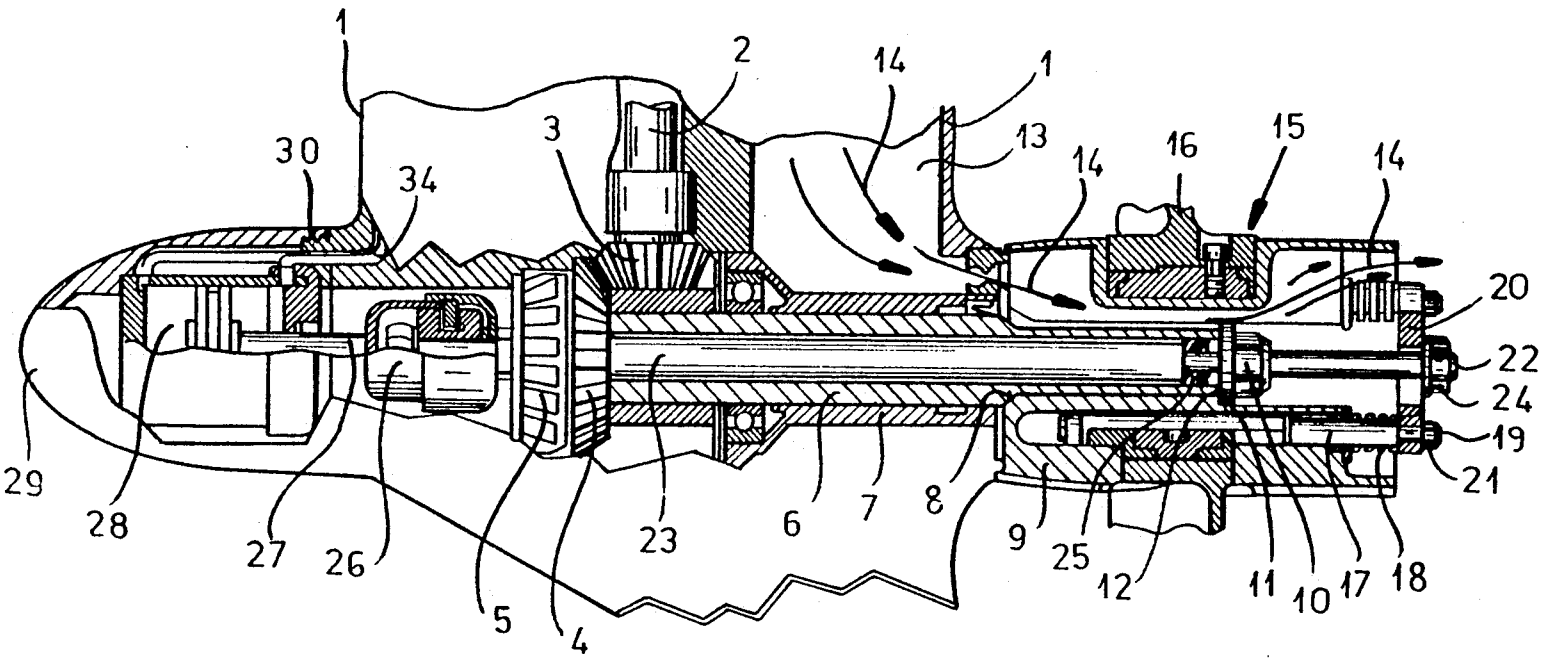
FIG. 1 is a side view of a boat drive according to the invention, partly in elevational and partly in section views through its lower part and in the form of an outboard motor with a variable pitch propeller.
Figure 2:
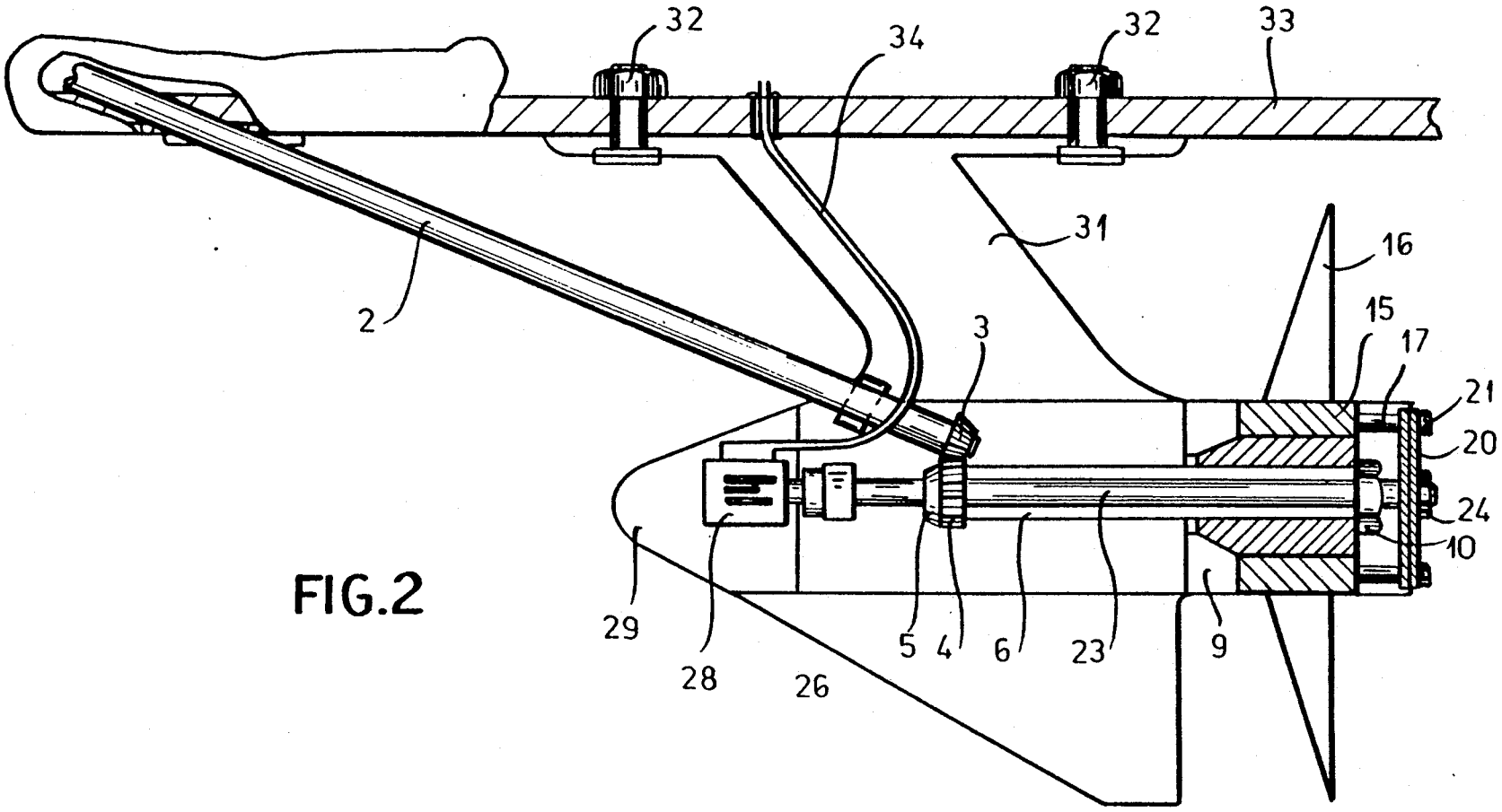
FIG. 2 is a schematic side elevational view, partly in diagrammatic section through a shaft palm and the variable pitch propeller associated therewith; an FIG. 3 is a detail view, drawn to a greater scale of a portion of the structure shown in FIG. 1.
Figure 3:
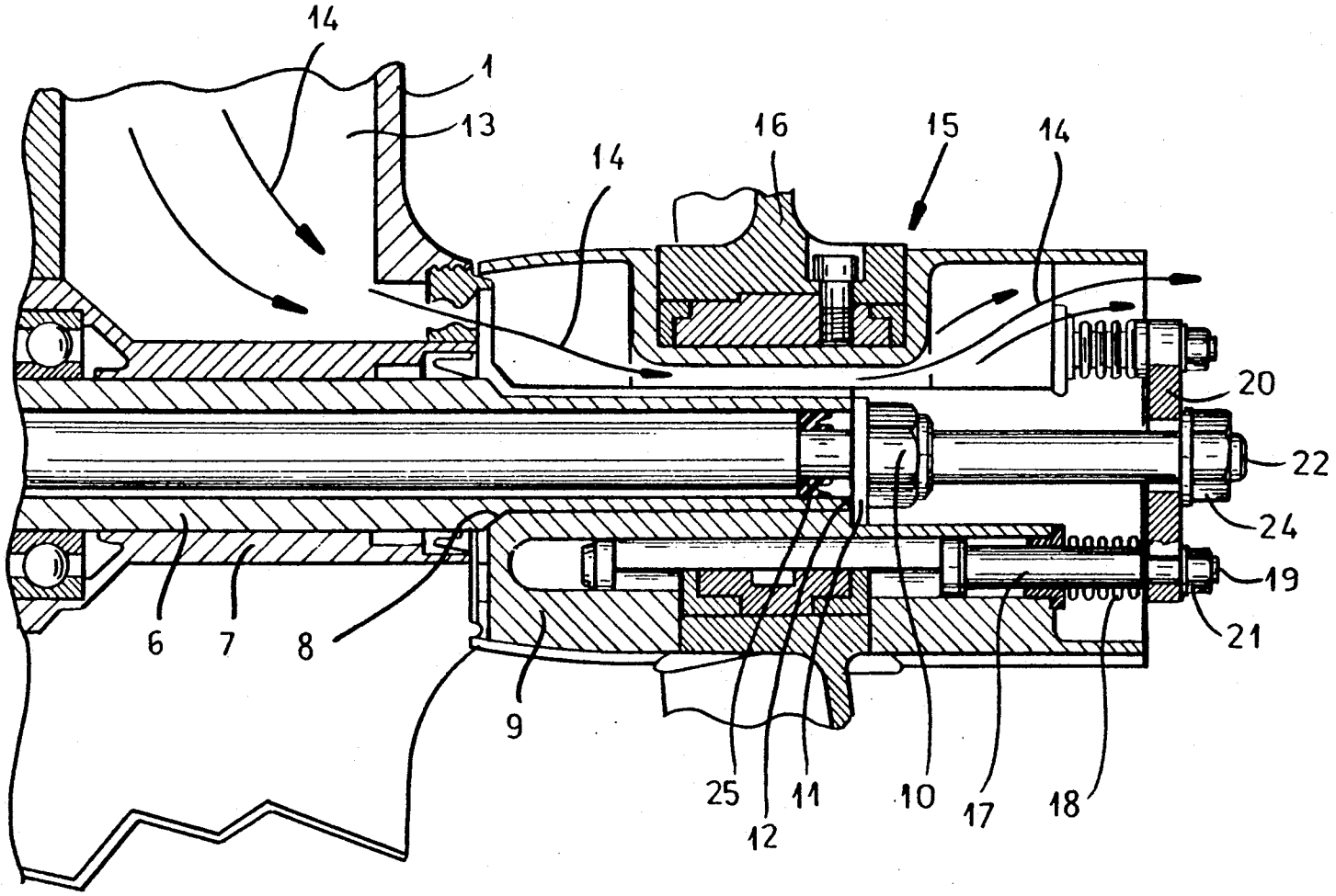

In FIGS. 1 and 3, we have shown a housing 1 of an outboard motor extending downwardly from the boat whose hull is not visible in FIG. 1. A boat hull 33 is visible in FIG. 2 which will be discussed in greater detail below.

In the housing 1 a drive shaft 2 is journaled and, at its upper end, is driven by a motor, for example, an internal combustion engine or an electric motor, not shown. At its lower end, this drive shaft 2 carries a bevel gear 3.

The bevel gear 3 measures with a bevel gear 4 and forms a transmission therewith located between a double acting cylinder unit 28 and the hub 9 of the propeller as will be described in detail. The bevel gear 4 bears against an axial bearing 5 of the thrust bearing type and is keyed to a hollow propeller shaft 7 journaled in a housing structure 7 formed at the bottom part of the housing 1.

Outside of the housing insert 7, the propeller shaft 6 has a shoulder 8 forming an abutment for one end of the hub 9 of a variable pitch propeller. The propeller shaft 6 extends substantially through one half the hub length and is provided at its free end with an external thread onto which a nut 10 can be screwed, this nut engaging a juxtaposed end face 12 of the hub 9 through the intermediary of a washer 11. Thus with the aid of the nut 10 the hub 6 is fastened to the propeller shaft 6 against the abutment 8. An additional key or other formation may be provided to insure a positive rotational connection between the propeller shaft and the hub 9.

The housing 1 is formed parallel to the drive shaft 2 with an exhaust gas passage 13 which can communicate through further passages in the hub 9 with the exterior below the water surface of the body of water in which the outboard motor is immersed so that the exhaust gas can be discharged at the free end of the hub 9. The path of the exhaust gas is represented by the arrows 14.

The hub 9 is provided with receptacles 15 for the respective blades which can be rotated about radial axes to adjust the pitches of the blades. The blades are represented at 16 and the pitch-adjustment mechanisms for each of the blades within the receptacles 15 have not been illustrated in detail since they are known from European Patent Publication EP 0231503. The respective mechanism is actuated by respective adjustment stems 17 which are axially displaceable parallel to the hollow propeller shaft 6.

To protect the mechanisms and the stems 17 against contamination, bellow seals 18 are provided.

At their free ends, the stems 17 have stepped threaded process 19 which pass through bores in a disk 20 which abuts shoulders held against these shoulders by nuts threaded onto the stepped threaded process 19.

In addition, the disk 20 has a central bore through which the stepped threaded end 22 of a push rod 23 can extend. The push rod is clamped to the disk 20 by a further nut 24. The nut clamps the disk 20 against a step or shoulder of the threaded end 22 of the push rod.

According to the invention, the push rod 23 extends entirely through the hollow propeller shaft and through the thrust bearing 5. At the hub-side end of the propeller shaft 6, the rod 23 is sealed thereagainst by a gland-type seal 25 (see especially FIG. 3).

On the opposite side of the thrust bearing 5, the rod 23 ends at an axial bearing 26 effective in both axial directions and on the other side of which a piston rod 27 of the double acting cylinder 28 is connected.

The piston-cylinder unit 27, 28 is received in a cap 29 which can be threaded at 30 onto the housing 1 and is flush therewith. The cap 29 has a streamlined configuration to minimize turbulence in the water flowing past the cap and housing. The cap and housing have passages accommodating the feed and return lines 34 for the pressure medium of the cylinder 28 which can extend to a pump and hydraulic control unit in the body of the boat.

The force generated by the cylinder 28 is transmitted by the push rod 23 which rotates with the hollow propeller shaft 6, to the disk 20 and from the disk 20 to the propeller blades 16 via the pitch adjusting mechanisms.

Should it be necessary, for repair or maintenance, to remove the variable pitch propeller, it is sufficient to remove the nuts 21, 24 and 10. This allows the hub 9 together with the blades 16 to be withdrawn from the propeller shaft 6.

If necessary, the housing insert 7 can be drawn off along the propeller shaft 6 as well since the passages provided in the housing 1 for discharge of the exhaust gases are of sufficient size to permit removal of this housing insert through the accessible right hand end of the assembly.

The cylinder 28 and the parts connected therewith are readily accessible upon removal of the cap 29.

In FIG. 2 similar functioning parts to those already described have identical reference numerals. In this case, however, the variable pitch propeller is mounted on a shaft palm which, by bolts 32, is fastened on the underside of the hull 33 of the boat. The drive shaft 2, in this embodiment, lies at an angle to the propeller shaft and extends from the hull 33 of the boat to the shaft palm 31. The gears 3 and 4 of the transmission are correspondingly configured. Exhaust gas passages can be provided in this embodiment if desired but have not been illustrated since they are not essential.

We claim:

1. A boat drive, comprising:

a drive housing projecting from a hull of a boat;

a hollow propeller shaft journaled in said housing;

means in said housing for rotating said propeller shaft;

a propeller hub mounted on said propeller shaft and provided with a plurality of adjustable-pitch propeller blades, and respective blade-adjustment stems extending parallel to said propeller shaft and shiftable in an axial direction to adjust a pitch of said blades, said hub having an end turned toward said housing and a free end turned away from said housing;

a pitch-adjustment push rod passing through said propeller shaft, projecting out of said hub with one extremity of said push rod at said free end of said hub and axially shiftable in said propeller shaft;

means for releasably connecting said one extremity to said blade-adjustment st®ms for varying the pitch of said blades upon axial displacement of said push rod, said push rod extending at an opposite extremity out of said propeller shaft; and a double-acting piston-and-cylinder unit in said housing connected to said opposite extremity of said push rod for axially displacing same.

2. The boat drive defined in claim 1 wherein said means for releasably connecting said one extremity to said blade-adjustment stems includes:

a disk; and screwthread means connecting said stems and said rod releasably to said disk.

3. The boat drive defined in claim 1 wherein said propeller shaft is formed with an abutment for said hub at a location spaced from an end of said propeller shaft connected to said hub, an external screwthread on said end of said propeller shaft, and a nut threaded onto said screwthread and retaining an end face of said hub against axial movement on said propeller shaft.

4. The boat drive defined in claim 1, further comprising seal means in a region of said hub for sealing between said push rod and said propeller shaft.

5. The boat drive defined in claim 1 wherein said double-acting piston-and-cylinder unit is provided in a removable cap of said housing.

6. The boat drive defined in claim 5 wherein said cap and a part of said housing to which said cap is connected are formed with passages accommodating fluid medium lines running to said unit.

7. The boat drive defined in claim 1, further comprising an axial bearing in said housing between said double-acting piston-and-cylinder unit and said push rod.

8. The boat drive defined in claim 1 wherein said means in said housing for rotating said propeller shaft includes a transmission connected to said propeller shaft between said double-acting piston-and-cylinder unit and said hub.

9. The boat drive defined in claim 1 wherein said means in said housing for rotating said propeller shaft includes a transmission connected to said propeller shaft and a drive shaft extending from said hull to a shaft palm affixed beneath said hull.

10. The boat drive defined in claim 9 wherein said drive shaft is inclined to said propeller shaft.

11. The boat drive defined in claim 1 wherein said means for releasably connecting said one extremity to said blade-adjustment stems includes:

a disk; and screwthread means connecting said stems and said rod releasably to said disk, said propeller shaft being formed with:

an abutment for said hub at a location spaced from an end of said propeller shaft connected to said hub;

an external screwthread on said end of said propeller shaft; and a nut threaded onto said screwthread and retaining an end face of said hub against axial movement on said propeller shaft.

12. The boat drive defined in claim 11, further comprising seal means in a region of said hub for sealing between said push rod and said propeller shaft.

13. The boat drive defined in claim 12 wherein said double-acting piston-and-cylinder unit is provided in a removable cap of said housing.

14. The boat drive defined in claim 13 wherein said cap and a part of said housing to which said cap is connected are formed with passages accommodating fluid medium lines running to said unit.

15. The boat drive defined in claim 14, further comprising an axial bearing in said housing between said double-acting piston-and-cylinder unit and said push rod.

16. The boat drive defined in claim 15 wherein said means in said housing for rotating said propeller shaft includes a transmission connected to said propeller shaft between said double-acting piston-and-cylinder unit and said hub.

* * * * *